US007394998B2

(12) United States Patent
Takagi

(10) Patent No.: US 7,394,998 B2
(45) Date of Patent: Jul. 1, 2008

(54) IMAGE FORMING APPARATUS AND DEVELOPER CARTRIDGE

(75) Inventor: Takeyuki Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 181 days.

(21) Appl. No.: 11/360,605

(22) Filed: Feb. 24, 2006

(65) Prior Publication Data

US 2006/0193644 A1 Aug. 31, 2006

(30) Foreign Application Priority Data

Feb. 28, 2005 (JP) ..... 2005-055106

(51) Int. Cl.
*G03G 15/00* (2006.01)

(52) U.S. Cl. ..... 399/12; 399/13; 399/30; 399/61

(58) Field of Classification Search ..... 399/12, 399/13, 25, 27, 30, 61, 119
See application file for complete search history.

(56) References Cited

U.S. PATENT DOCUMENTS

| | | | | |
|---|---|---|---|---|
| 5,499,077 | A * | 3/1996 | Endo et al. | 399/27 |
| 5,532,790 | A * | 7/1996 | Akazawa | 399/64 |
| 5,899,597 | A * | 5/1999 | Shinohara et al. | 399/64 |
| 5,970,286 | A | 10/1999 | Numazu et al. | |
| 6,061,535 | A * | 5/2000 | Yokomori et al. | 399/61 |
| 6,510,303 | B2 * | 1/2003 | Bessette | 399/256 |
| 6,546,212 | B1 * | 4/2003 | Ogata et al. | 399/24 |
| 6,795,673 | B2 * | 9/2004 | Yoshizawa | 399/284 |
| 7,050,728 | B2 * | 5/2006 | Minagawa et al. | 399/27 |
| 2001/0036368 | A1 * | 11/2001 | Curry et al. | 399/12 |
| 2001/0051051 | A1 * | 12/2001 | Matsumoto | 399/13 |
| 2005/0031359 | A1 | 2/2005 | Ishii | |

FOREIGN PATENT DOCUMENTS

| | | |
|---|---|---|
| JP | A 63-259672 | 10/1988 |
| JP | A 07-152307 | 6/1995 |
| JP | A 11-202715 | 7/1999 |
| JP | A 11-338210 | 12/1999 |
| JP | A 2000-221781 | 8/2000 |
| JP | A 2000-258964 | 9/2000 |

* cited by examiner

*Primary Examiner*—David M. Gray
*Assistant Examiner*—Kristofferson Service
(74) *Attorney, Agent, or Firm*—Oliff & Berrodge, PLC

(57) ABSTRACT

A developer cartridge is configured to be detachably mounted in an apparatus main body and to accommodate developer. The developer cartridge includes a drive member and a display portion. The drive member is configured to be driven to move by a driving force when the developer cartridge is mounted in the apparatus main body. The display portion is configured to move together with the drive member. The display portion displays identification information relating to the developer cartridge in an optically readable manner. A detecting portion optically detects the identification information when the display portion is in a first position, and optically detects presence or absence of the developer in the developer cartridge when the display portion is in a second position different from the first position. An information determining portion determines information on the developer cartridge based on the identification information detected by the detecting portion.

17 Claims, 7 Drawing Sheets

IMAGE FORMING APPARATUS AND DEVELOPER CARTRIDGE

CROSS REFERENCE TO RELATED APPLICATIONS

This application claims priority from Japanese Patent Application No. 2005-055106 filed Feb. 28, 2005. The entire content of the priority application is incorporated herein by reference.

TECHNICAL FIELD

The invention relates to an image forming apparatus such as a laser printer, and a developer cartridge detachably mounted in the image forming apparatus.

BACKGROUND

In conventional laser printers, developer cartridges accommodating toner are detachably mounted therein. This type of laser printer is provided with new product detecting means for detecting whether the developer cartridge mounted in the laser printer is a new product and for determining the life of the developer cartridge from the point that the new product was detected.

For example, Japanese Patent Application Publication No. 2000-221781 proposes a developing device in which is provided a sector gear having a recessed part and a protruding part. When a new developing device is mounted in the body of an electrophotographic image forming apparatus, the protruding part formed on the sector gear is inserted into a new product side sensor, turning the new product side sensor on. After the developing device has been mounted in the body of the image forming apparatus, an idler gear is driven to rotate. When the idler gear begins to rotate, the sector gear also rotates, moving the protruding part from the new product side sensor to an old product side sensor. The protruding part is inserted into the old product side sensor, turning the old product side sensor on. At the same time, the idler gear arrives at the recessed part of the sector gear, and the sector gear stops rotating.

SUMMARY

However, in the new product detecting means described in Japanese Patent Application Publication No. 2000-221781, both a new product side sensor and an old product side sensor are essential because the protruding part is inserted either into the new product sensor for detecting a new product or the old product sensor for detecting an old product. Accordingly, this structure increases the cost and complexity of the developing device.

Further, some users have requested the freedom to select an optimum developer cartridge from a plurality of developer cartridges in different price ranges corresponding to the amount of toner accommodated therein with consideration for cost and frequency of use.

To meet this demand, developer cartridges accommodating different amounts of toner must be provided. However, the toner accommodated in these developer cartridges has different agitation properties and different rates of degradation based on the amount of toner.

Under these circumstances, it is not sufficient merely to detect whether the developer cartridge is a new product since the life of the developer cartridge from this point of detection may differ according to the amount toner accommodated therein. Accordingly, the life of the developer cartridge cannot be accurately determined. As a result, a developer cartridge accommodating a small amount of toner may actually reach the end of its life before such a determination is made, resulting in a decline in image quality.

In view of the foregoing, it is an object of the invention to provide an image forming apparatus capable of determining information on a developer cartridge, while suppressing a rise in manufacturing costs and avoiding an increase in structural complexity. It is another object of the invention to provide a developer cartridge detachably mounted in the image forming apparatus.

In order to attain the above and other objects, according to one aspect, the invention provides an image forming apparatus. The image forming apparatus includes an apparatus main body, a driving-force generating portion, a developer cartridge, a detecting portion, and an information determining portion. The driving-force generating portion is disposed in the apparatus main body and generates a driving force. The developer cartridge is configured to be detachably mounted in the apparatus main body and to accommodate developer. The developer cartridge includes a drive member and a display portion. The drive member is configured to be driven to move by the driving force when the developer cartridge is mounted in the apparatus main body. The display portion is configured to move together with the drive member. The display portion displays identification information relating to the developer cartridge in an optically readable manner. The detecting portion optically detects the identification information when the display portion is in a first position, and optically detects presence or absence of the developer in the developer cartridge when the display portion is in a second position different from the first position. The information determining portion determines information on the developer cartridge based on the identification information detected by the detecting portion.

According to another aspect, the invention provides a developer cartridge configured to be detachably mounted in an apparatus main body of an image forming apparatus and to accommodate developer. The developer cartridge includes a drive member and a display portion. The drive member is configured to be driven to move by a driving force when the developer cartridge is mounted in the apparatus main body. The display portion is configured to move together with the drive member. The display portion displays identification information relating to the developer cartridge in an optically readable manner. The identification information can be optically detected by a detecting portion provided in the apparatus main body when the display portion is in a first position, and the presence or absence of the developer can be optically detected by the detecting portion when the display portion is in a second position different from the first position.

According to another aspect, the invention provides a developer cartridge configured to be detachably mounted in an apparatus main body of an image forming apparatus and to accommodate developer. The developer cartridge includes a drive member, a display portion, and a transmission portion. The drive member is configured to be driven to move by a driving force when the developer cartridge is mounted in the apparatus main body. The display portion is provided on the drive member and displays identification information relating to the developer cartridge in an optically readable manner. The transmission portion is formed in the drive member and is configured to transmit light. Both the display portion and the transmission portion are configured to move together with the drive member and to pass through a predetermined position.

BRIEF DESCRIPTION OF THE DRAWINGS

Illustrative aspects in accordance with the invention will be described in detail with reference to the following figures wherein.

DETAILED DESCRIPTION

<Overall Structure of Laser Printer>

Figure 1:
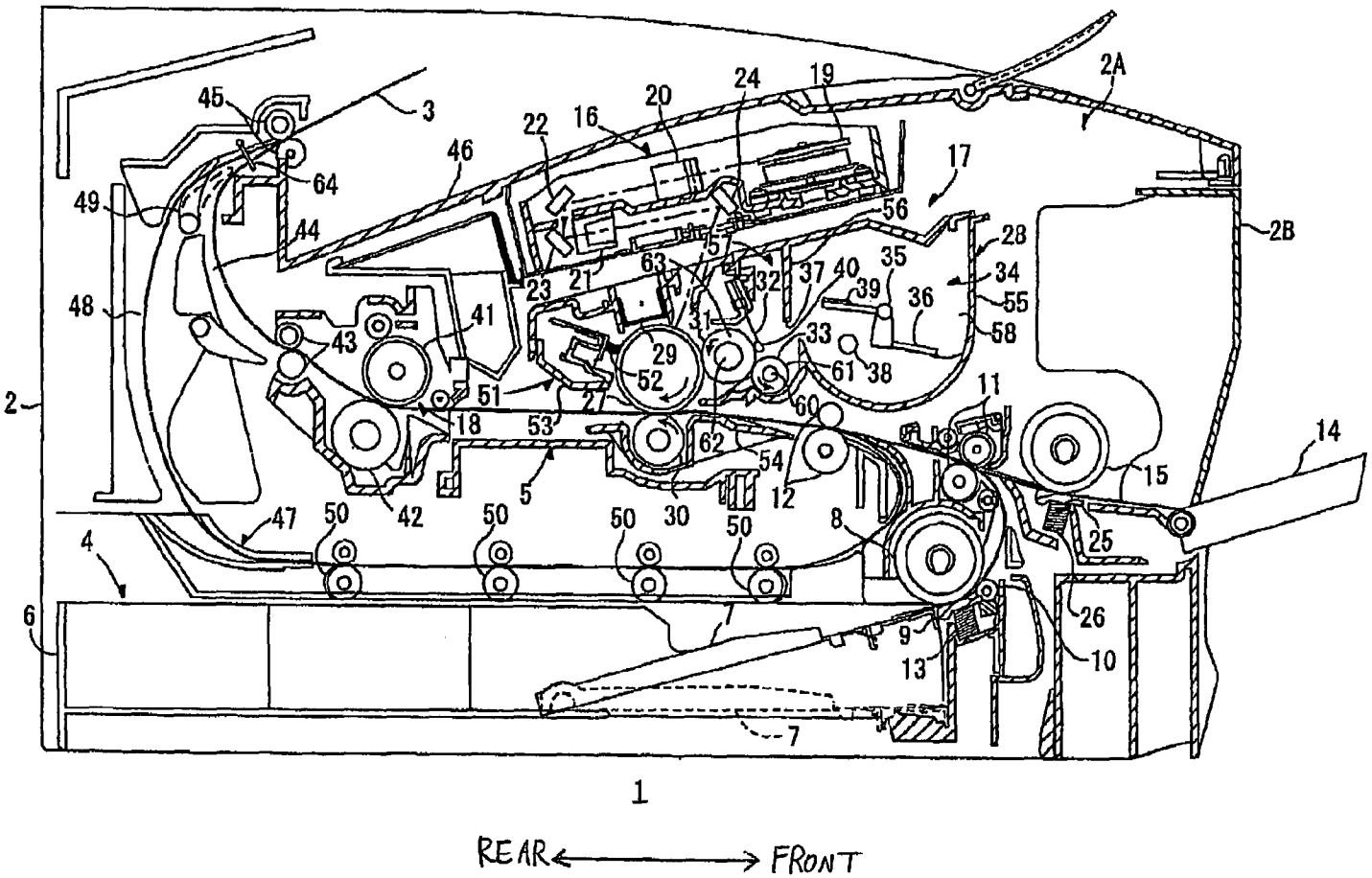
FIG. 1 is a vertical cross-sectional view of a laser printer according to illustrative aspects of the invention.

An image forming apparatus and a developer cartridge according to illustrative aspects of the invention will be described with reference to FIGS. 1 through 9. As shown in FIG. 1, a laser printer 1 includes a main casing 2, a feeder unit 4, and an image forming unit 5. The feeder unit 4 and the image forming unit 5 are housed in the main casing 2. The feeder unit 4 supplies sheets 3 to the image forming unit 5. The image forming unit 5 forms desired images on the supplied sheets 3.

<Structure of Main Casing>

An access opening 2A is formed in one side surface (the right side in FIG. 1) of the main casing 2 for inserting and removing a process cartridge 17 described later. A front cover 2B is disposed on the side surface of the main casing 2 and is capable of opening and closing over the access opening 2A. The front cover 2B is rotatably supported by a cover shaft (not shown) inserted through a bottom end of the front cover 2B. When the front cover 2B is rotated closed about the cover shaft, the front cover 2B covers the access opening 2A, as shown in FIG. 1. When the front cover 2B is rotated open about the cover shaft (rotated downward), the access opening 2A is exposed, enabling the process cartridge 17 to be mounted into or removed from the main casing 2 via the access opening 2A.

In the following description, the "front" is used to define the side at which the front cover 2B is provided, and the "rear" is used to define the opposite side.

<Structure of Feeder Unit>

The feeder unit 4 is located within the lower section of the main casing 2 and includes a sheet supply tray 6, a sheet pressing plate 7, a sheet supply roller 8, a sheet supply pad 9, paper dust removing rollers 10, 11, and a pair of registration rollers 12. The sheet supply tray 6 is detachably mounted with respect to the main casing 2. The sheet pressing plate 7 is pivotally movably provided within the sheet supply tray 6. The sheet supply roller 8 and the sheet supply pad 9 are provided above the front end of the sheet supply tray 6. The paper dust removing rollers 10, 11 are disposed downstream from the sheet supply roller 8 with respect to the direction in which the sheets 3 are transported. The registration rollers 12 are provided downstream from the paper dust removing rollers 10, 11 in the sheet transport direction of the sheets 3.

The sheet pressing plate 7 is capable of supporting a stack of sheets 3. The sheet pressing plate 7 is pivotally supported at its end furthest from the supply roller 8 so that the end of the sheet pressing plate 7 that is nearest the supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the urging force of the spring. The sheet supply roller 8 and the sheet supply pad 9 are disposed in confrontation with each other. A spring 13 is provided beneath the sheet supply pad 9 for pressing the sheet supply pad 9 toward the sheet supply roller 8.

Urging force of the spring under the sheet pressing plate 7 presses the uppermost sheet 3 on the sheet pressing plate 7 toward the supply roller 8 so that rotation of the supply roller 8 moves the uppermost sheet 3 between the supply roller 8 and the separation pad 13. In this way, one sheet 3 at a time is separated from the stack and supplied to the paper dust removing rollers 10, 11.

The paper dust removing rollers 10, 11 remove paper dust from the supplied sheets 3 and further convey the same to the registration rollers 12. The pair of registration rollers 12 performs a desired registration operation on the supplied sheets 3. Then the sheets 3 are transported to an image formation position. In the image formation position a photosensitive drum 27 and a transfer roller 30 contact each other. In other words, the image formation position is a transfer position where the visible toner image is transferred from a surface of the photosensitive drum 27 to a sheet 3 as the sheet 3 passes between the photosensitive drum 27 and the transfer roller 30.

The feeder unit 4 further includes a multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 26 provided beneath the multipurpose sheet supply pad 25 presses the multipurpose sheet supply pad 25 up toward the multipurpose sheet supply roller 15.

Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation position.

<Structure of Image Forming Section>

The image forming section 5 includes a scanner section 16, a process cartridge 17, and a fixing section 18.

<Structure of Scanner Section>

The scanner section 16 is provided at the upper section of the casing 2 and is provided with a laser emitting section (not shown), a rotatingly driven polygon mirror 19, lenses 20, 21, and reflection mirrors 22, 23, 24. The laser emitting section emits a laser beam based on desired image data. As indicated by single-dot chain line in FIG. 1, the laser beam passes through or is reflected by the mirror 19, the lens 20, the reflection mirrors 22 and 23, the lens 21, and the reflection mirror 24 in this order so as to irradiate, in a high speed scanning operation, the surface of the photosensitive drum 27 of the process cartridge 17.

<Structure of Process Cartridge>

The process cartridge 17 is disposed below the scanning unit 16 and includes a process frame 51 that is detachably mounted in the main casing 2. Within the process frame 51, the process cartridge 17 also includes a developer cartridge 28, the photosensitive drum 27, a Scorotron charger 29, an electrically conductive brush 52, and the transfer roller 30.

The process frame 51 includes an upper frame 53 and a lower frame 54. A paper-conveying path along which the sheets 3 are conveyed is formed between the upper frame 53 and lower frame 54. The upper frame 53 accommodates the photosensitive drum 27, charger 29, and brush 52. The developer cartridge 28 is detachably mounted on the upper frame 53. The lower frame 54 accommodates the transfer roller 30.

The photosensitive drum 27 is cylindrical in shape. The outermost surface of the photosensitive drum 27 is formed of a positive-charging photosensitive layer of polycarbonate or the like. The photosensitive drum 27 is supported on the upper frame 53 by a metal drum shaft (not shown) extending along the length of the photosensitive drum 27 through the axial center of the same. The photosensitive drum 27 is capable of rotating about the drum shaft in the process frame 51. Further, the photosensitive drum 27 is driven to rotate by a driving force inputted from a motor 59 (see FIG. 2).

The charger 29 is supported on the upper frame 53 and is disposed in opposition to the photosensitive drum 27 from a position above the same. The charger 29 is separated a predetermined distance from the photosensitive drum 27 so as not to contact the same. The charger 29 is a positive-charging Scorotron type charger that produces a corona discharge from a discharge wire formed of tungsten or the like in order to form a uniform charge of positive polarity over the surface of the photosensitive drum 27.

The transfer roller 30 is disposed in opposition to and in contact with the photosensitive drum 27 from a position below the same. The transfer roller 30 is supported on the lower frame 54 so as to be able to rotate in the direction indicated by the arrow (counterclockwise in FIG. 1). The transfer roller 30 is an ion-conducting transfer roller configured of a metal roller shaft covered by a roller that is formed of an electrically conductive rubber material. During a transfer operation, a transfer bias is applied to the transfer roller 30 by a constant current control. Further, the transfer roller 30 is driven to rotate by a driving force inputted from the motor 59.

The brush 52 is disposed in opposition to the photosensitive drum 27 on the rear side of the same (the left side in FIG. 1). The brush 52 is fixed to the upper frame 53 so that a free end of the brush 52 contacts the surface of the photosensitive drum 27.

The developer cartridge 28 includes a casing 55 and, within the casing 55, a developing roller 31, a thickness-regulating blade 32, and a supply roller 33.

The developer cartridge 28 is detachably mounted on the process frame 51. Hence, when the process cartridge 17 is mounted in the main casing 2, the developer cartridge 28 can be mounted in the main casing 2 by first opening the front cover 2B and subsequently inserting the developer cartridge 28 through the access opening 2A and mounting the developer cartridge 28 on the process cartridge 17.

The casing 55 has a box shape that is open on the rear side. A partitioning plate 56 is provided midway in the casing 55 in the front-to-rear direction for partitioning the interior of the casing 55. The front region of the casing 55 partitioned by the partitioning plate 56 serves as a toner-accommodating chamber 34 (developer accommodating portion) for accommodating toner, while the rear region of the casing 55 partitioned by the partitioning plate 56 serves as a developing chamber 57 in which are provided the developing roller 31, thickness-regulating blade 32, and supply roller 33. An opening 37 is formed below the partitioning plate 56 to allow the passage of toner in a front-to-rear direction.

The toner-accommodating chamber 34 is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known copolymerizing processes, such as suspension polymerization. Examples of a polymerizing monomer include a styrene type monomer or an acrylic type monomer. An example of a styrene type monomer is styrene. Examples of acrylic type monomers are acrylic acid, alkyl (C1-C4) acrylate, and alkyl(C1-C4) methacrylate. Because the polymerization toner has such an excellent fluidity characteristic, image development is reliably performed so that high-quality images can be formed. Materials such as wax and a coloring agent are distributed in the toner. The coloring agent can be carbon black, for example. In addition, external additive, such as silica, are added in the toner to further improve the fluidity characteristic. The toner has a particle diameter of about 6-10 μm.

An agitator rotational shaft 35 is disposed in the center of the toner-accommodating chamber 34. The agitator rotational shaft 35 is rotatably supported in side walls 58 (see FIG. 2) of the casing 55. The side walls 58 confront each other laterally (direction orthogonal to the front-to-rear direction and vertical direction) but are separated from each other by a predetermined distance. An agitator 36 is disposed on the agitator rotational shaft 35. The motor 59 (see FIG. 2) produces a driving force that is inputted into the agitator rotational shaft 35 for driving the agitator 36 to rotate. When driven to rotate, the agitator 36 stirs the toner inside the toner-accommodating chamber 34 so that some of the toner is discharged toward the supply roller 33 through the opening 37 formed below the partitioning plate 56.

Toner detection windows 38 (see FIG. 8) are provided in both side walls 58 of the casing 55 at positions corresponding to the toner-accommodating chamber 34 for detecting the amount of toner remaining in the toner-accommodating chamber 34. The toner detection windows 38 oppose each other laterally across the toner-accommodating chamber 34. As will be described later in detail, a light-emitting element 89 (see FIG. 8) is provided on the main casing 2 outside one of the toner detection windows 38, while a second light-receiving element 91 (see FIG. 8) is provided on the main casing 2 outside the other of the toner detection windows 38. Light emitted from the light-emitting element 89 passes into the toner-accommodating chamber 34 through one of the toner detection windows 38. The second light-receiving element 91 detects this light as a detection light when the light passes through the toner-accommodating chamber 34 and exits the other toner detection window 38. The laser printer 1 can determine the amount of remaining toner based on these detection results. Further, a cleaner 39 is supported on the agitator rotational shaft 35 for cleaning the toner detection windows 38.

The supply roller 33 is disposed rearward of the opening 37 and includes a metal supply roller shaft 60 covered by a sponge roller 61 formed of an electrically conductive foam material. The metal supply roller shaft 60 is rotatably supported in both side walls 58 of the casing 55 at a position corresponding to the developing chamber 57. The supply roller 33 is driven to rotate by a driving force inputted into the metal supply roller shaft 60 from the motor 59 (see FIG. 2).

The developing roller 31 is disposed rearward of the supply roller 33 and contacts the supply roller 33 with pressure so that both are compressed. The developing roller 31 includes a metal developing roller shaft 62, and a rubber roller 63 formed of an electrically conductive rubber material that covers the metal developing roller shaft 62. The metal developing roller shaft 62 is rotatably supported in both side walls 58 of the casing 55 at a position corresponding to the developing chamber 57. The rubber roller 63 is more specifically formed of an electrically conductive urethane rubber or silicon rubber containing fine carbon particles, the surface of which is coated with urethane rubber or silicon rubber containing fluorine. The developing roller 31 is driven to rotate by a driving force inputted into the metal developing roller shaft 62 from the motor 59 (see FIG. 2). A developing bias is applied to the developing roller 31 during a developing operation.

The layer thickness regulating blade 32 is disposed near the developing roller 31. The layer thickness regulating blade 32 includes a blade made from a metal leaf spring, and has a pressing member 40, that is provided on a free end of the blade. The pressing member 40 has a semi-circular shape when viewed in cross section. The pressing member 40 is formed from silicone rubber with electrically insulating properties. The layer thickness regulating blade 32 is supported by the casing 55 at a location near the developing roller 31. The resilient force of the blade presses the pressing member 40 against the surface of the developing roller 31.

Then rotation of the supply roller 33 supplies the developing roller 31 with the toner that has been discharged through the opening 37. At this time, the toner is triboelectrically charged to a positive charge between the supply roller 33 and the developing roller 31. Then, as the developing roller 31 rotates, the toner supplied onto the developing roller 31 moves between the developing roller 31 and the pressing member 40 of the layer thickness regulating blade 32. This reduces thickness of the toner on the surface of the developing roller 31 down to a thin layer of uniform thickness.

As the photosensitive drum 27 rotates, the charger 29 charges the surface of the photosensitive drum 27 with a uniform positive polarity. Subsequently, the scanning unit 16 irradiates a laser beam over the positively charged surface of the casing 55 in a high-speed scan to form an electrostatic latent image corresponding to an image to be formed on the sheet 3.

Next, an inverse developing process is performed. That is, as the developing roller 31 rotates, the positively-charged toner borne on the surface of the developing roller 31 is brought into contact with the photosensitive drum 27. At this time, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

Subsequently, as the registration rollers 12 convey a sheet 3 through the transfer position between the photosensitive drum 27 and transfer roller 30, the toner image carried on the surface of the photosensitive drum 27 is transferred onto the sheet 3 due to the transfer bias applied to the transfer roller 30. After the toner image is transferred, the sheet 3 is conveyed to the fixing unit 18.

During the transfer operation, paper dust is deposited on the surface of the photosensitive drum 27 when the photosensitive drum 27 contacts the sheet 3. As the photosensitive drum 27 continues to rotate after the transfer operation, the brush 52 removes this paper dust from the surface of the photosensitive drum 27 as the surface of the photosensitive drum 27 rotates opposite the brush 52.

In the laser printer 1, residual toner which is left on the surface of the photosensitive drum 27 after a transfer to the sheet 3 is recovered by the developing roller 31. That is, the residual toner is recovered using a so-called cleanerless method. By recovering the residual toner using the cleanerless method, a toner cleaning device and a used-toner reservoir become unnecessary, which simplifies the construction of the device.

<Structure of Fixing Section>

As shown in FIG. 1, the fixing section 18 is disposed downstream from the process cartridge 17 and includes a heat roller 41, a pressing roller 42, and transport rollers 43. The pressing roller 42 presses against the heat roller 41. The transport rollers 43 are provided downstream from the heat roller 41 and the pressing roller 42.

The heat roller 41 includes a metal tube and a halogen lamp disposed therein. The halogen lamp heats up the metal tube so that toner that has been transferred onto sheet 3 in the process cartridge 17 is thermally fixed onto the sheet 3 as the sheet 3 passes between the heat roller 41 and the pressing roller 42. Afterward, the sheet 3 is transported to a sheet-discharge path 44 by the transport rollers 43 and discharged onto a sheet-discharge tray 46 by sheet-discharge rollers 45.

<Structure of Both-Side Printing Mechanism>

The laser printer 1 is further provided with an inverting transport unit 47 (both-side printing mechanism) for inverting sheets 3 that have been printed on once and for returning the sheets 3 to the image forming unit 5 so that images can be formed on both sides of the sheets 3. The inverting transport unit 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheets 3 onto the sheet-discharge tray 46 and rotated in reverse when sheets are to be inverted.

The inversion transport rollers 50 are disposed below the image forming unit 5. The inversion transport path 48 extends vertically between the sheet-discharge rollers 45 and the inversion transport rollers 50. The upstream end of the inversion transport path 48 is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line and the orientation shown by solid line in FIG. 1. The orientation shown in solid line in FIG. 1 is for transporting sheets 3 that have one side printed to the sheet-discharge rollers 45. The orientation shown in broken line in FIG. 1 is for transporting sheets from the sheet-discharge rollers 45 into the inversion transport path 48, rather than back into the sheet-discharge path 44.

The inversion transport rollers 50 are aligned horizontally at positions above the sheet supply tray 6. The pair of inversion transport rollers 50 that is farthest upstream is disposed near the rear end of the inversion transport path 48. The pair of inversion transport rollers 50 that is located farthest downstream is disposed below the registration rollers 12.

The inverting transport unit 47 operates in the following manner when a sheet 3 is to be formed with images on both sides. A sheet 3 that has been formed on one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45. Then, the sheet-discharge rollers 45 are driven to rotate in reverse while at the same time the flapper 49 is switched to change transport direction of the sheet 3 toward the inversion transport path 48. As a result, the sheet 3 is transported into the inversion transport path 48. The flapper 49 reverts to its initial position once transport of the sheet 3 to the inversion transport path 48 is completed. That is, the flapper 49 switches back to the position for transporting sheets from the transport rollers 43 to the sheet-discharge rollers 45.

Next, the inverted sheet 3 is transported through the inversion transport path 48 to the inversion transport rollers 50 and then upward from the inversion transport rollers 50 to the registration rollers 12. The registration rollers 12 align the front edge of the sheet 3. Afterward, the sheet 3 is transported toward the image formation position. At this time, the upper and lower surfaces of the sheet 3 are reversed from the first time that an image has been formed on the sheet 3 so that an image can be formed on the other side as well. In this way, images are formed on both sides of the sheet 3.

A paper discharge sensor 64 is disposed along the paper discharge path 44 upstream of the discharge rollers 45. The paper discharge sensor 64 pivots each time a sheet 3 conveyed along the paper discharge path 44 in the discharge direction passes the paper discharge sensor 64. A CPU 100 (see FIG. 8) provided in the main casing 2 counts the number of times that the paper discharge sensor 64 pivots and stores this number as the number of printed sheets.

In the laser printer 1 having this construction, the CPU 100 (see FIG. 8) determines whether the developer cartridge 28 mounted in the main casing 2 is a new product and determines the maximum number of sheets to be printed with the developer cartridge 28 when the developer cartridge 28 is new, as will be described later. The CPU 100 compares the actual number of printed sheets since the new developer cartridge 28 was mounted with the maximum number of sheets to be printed with the developer cartridge 28, and displays an out-of-toner warning on a control panel or the like (not shown) either when the actual number of printed sheets reaches the maximum number of sheets to be printed or when it is determined that there is no toner in the toner-accommodating chamber 34 based on a light-receiving signal inputted from the second light-receiving element 91 (see FIG. 8).

<Structure for Detecting a New Developer Cartridge>

Figure 7:
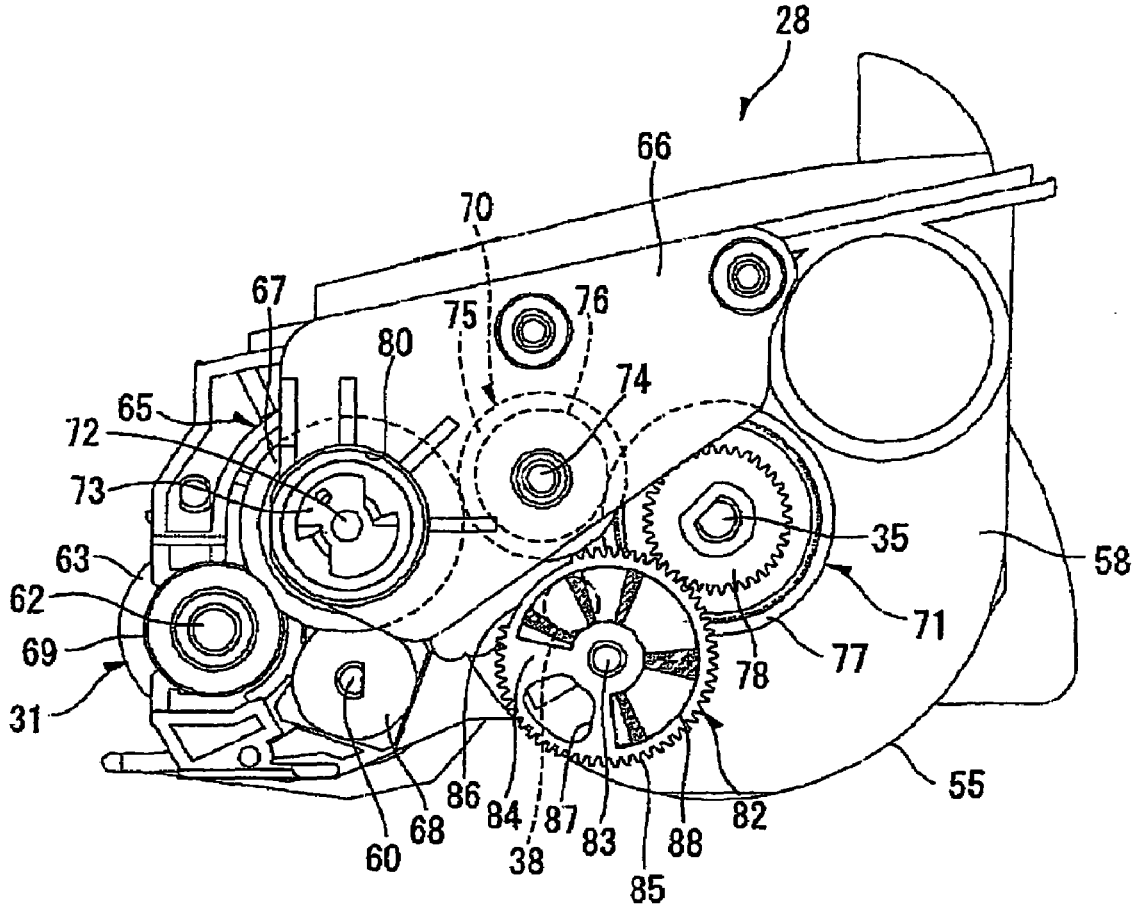
FIG. 7 is a side view of a developer cartridge (maximum number of sheets to be printed is 3000) shown in FIG. 1.
Figure 8:
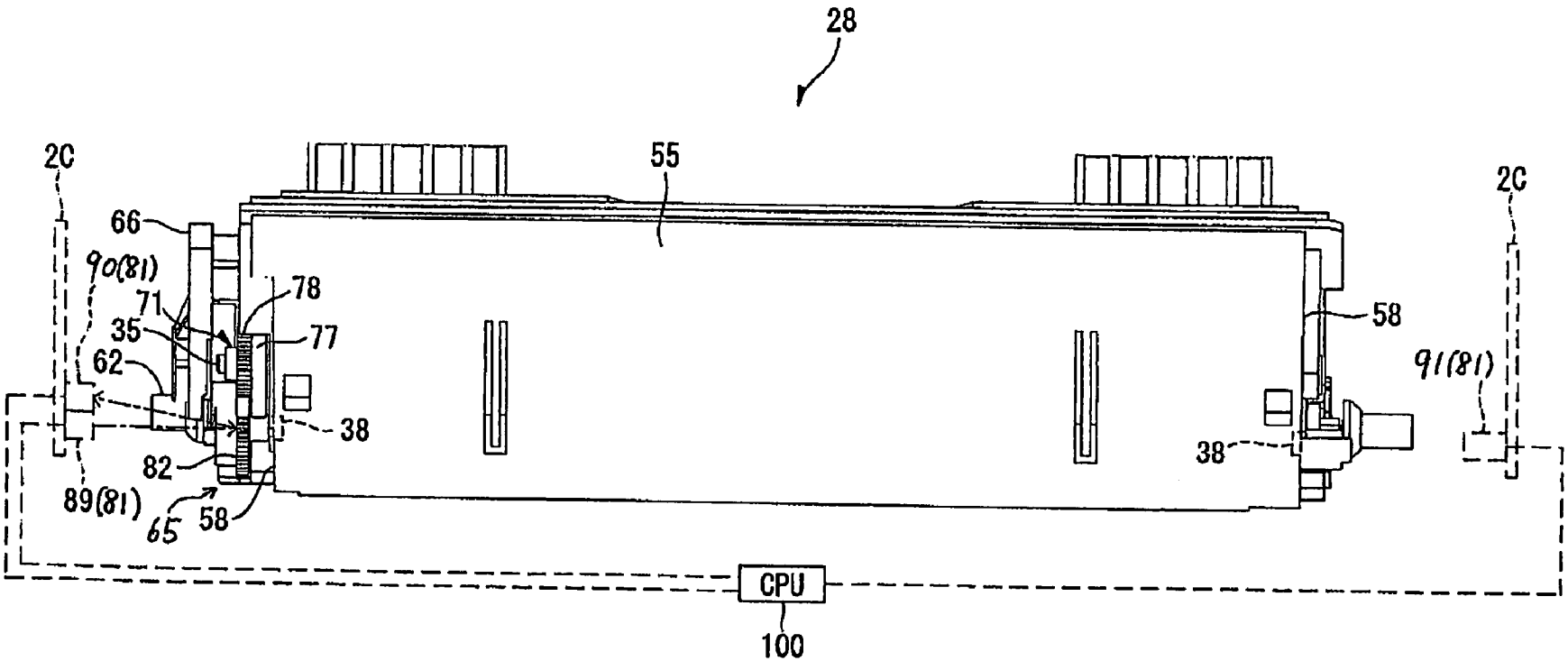
FIG. 8 is a plan view of the developer cartridge shown in FIG. 1 in a state where a detection light is received by a first light-receiving element.
Figure 9:
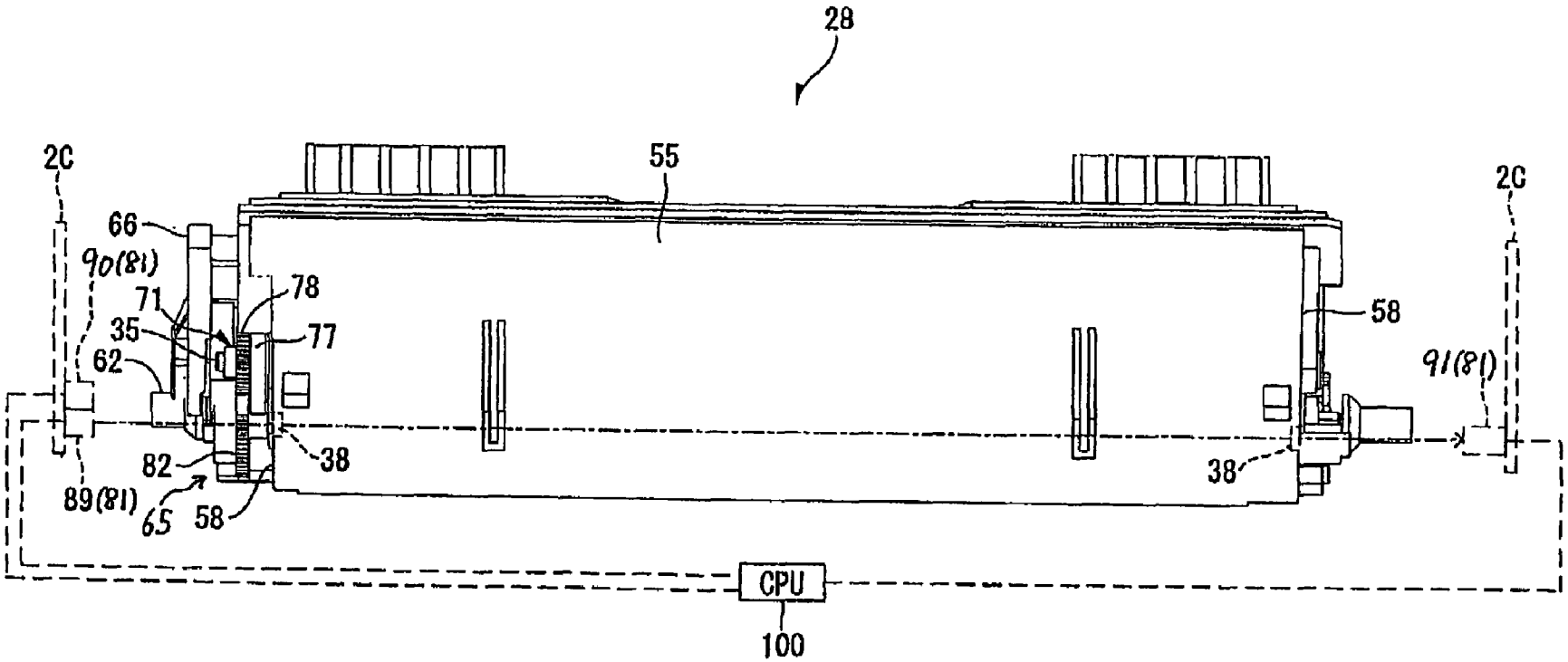
FIG. 9 is a plan view of the developer cartridge shown in FIG. 1 in a state where a detection light is received by a second light-receiving element.

FIGS. 2 through 6 are side views of the developer cartridge 28 (maximum number of sheets to be printed is 6000) shown in FIG. 1. FIG. 7 is a side view of the developer cartridge 28 (maximum number of sheets to be printed is 3000) shown in FIG. 1. FIGS. 8 and 9 are plan views of the developer cartridge 28 shown in FIG. 1.

Figure 2:
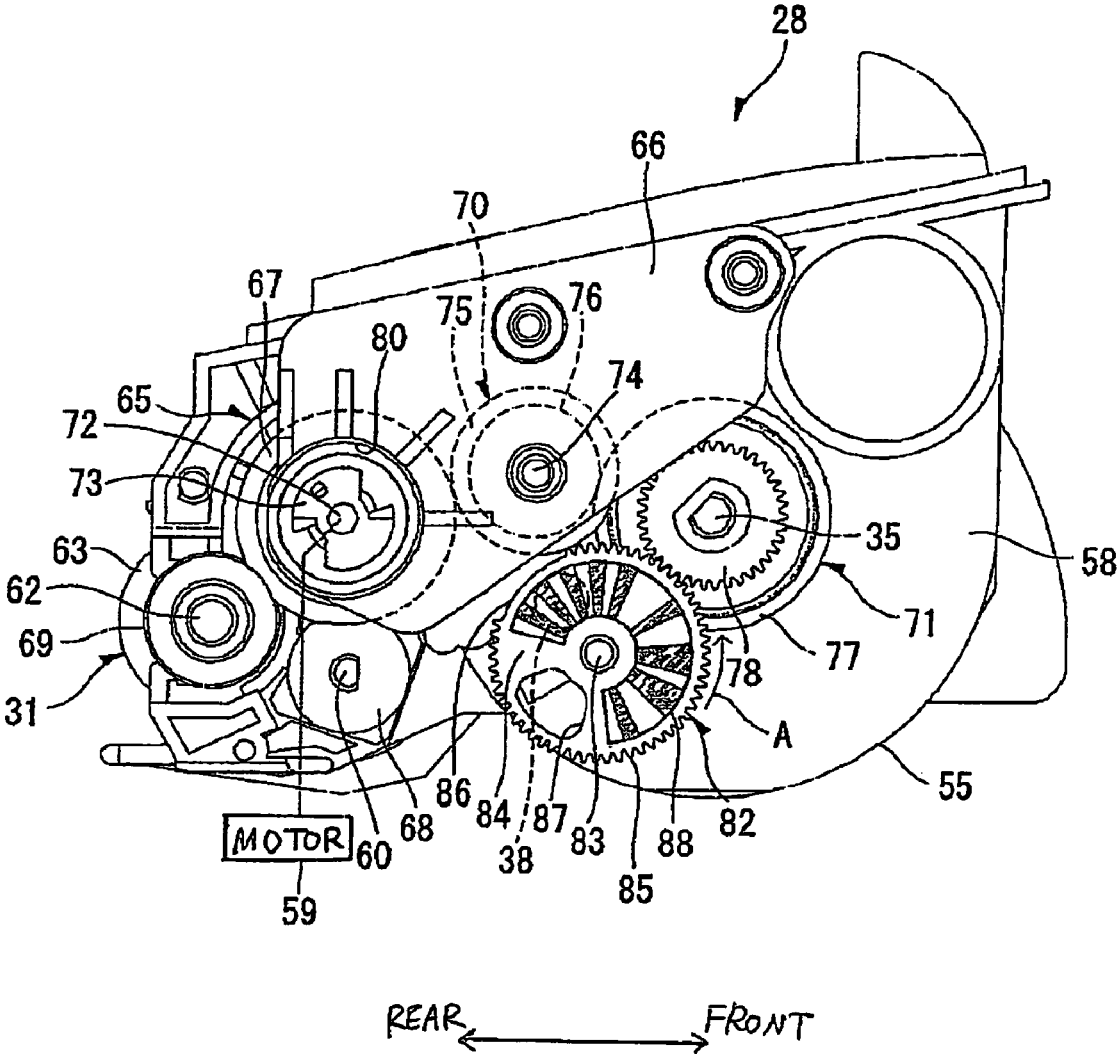
FIG. 2 is a side view of a developer cartridge shown in FIG. 1 (maximum number of sheets to be printed is 6000) before an idle rotation operation.

As shown in FIG. 2, the developer cartridge 28 includes a gear mechanism 65 for rotating the agitator rotational shaft 35 of the agitator 36, the metal supply roller shaft 60 of the supply roller 33, and the metal developing roller shaft 62 of the developing roller 31; and a gear cover 66 for covering the gear mechanism 65.

The gear mechanism 65 is disposed on one of the side walls 58 configuring the casing 55 of the developer cartridge 28. The gear mechanism 65 includes an input gear 67, a supply roller drive gear 68, a developer roller drive gear 69, an intermediate gear 70, an agitator drive gear 71, and a detection gear 82 serving as a drive member.

The input gear 67 is disposed between the metal developing roller shaft 62 and the agitator rotational shaft 35 and is rotatably supported on an input gear support shaft 72 that protrudes laterally from the outer side of one side wall 58. A coupling receiving part 73 is disposed in the axial center of the input gear 67 for inputting a driving force from the motor 59 provided in the main casing 2 when the developer cartridge 28 is mounted in the main casing 2.

The supply roller drive gear 68 is disposed below the input gear 67 on an axial end of the metal supply roller shaft 60 so as to be engaged with the input gear 67. The supply roller drive gear 68 is incapable of rotating relative to the metal supply roller shaft 60.

The developer roller drive gear 69 is disposed diagonally below and rearward of the input gear 67 on an end of the metal developing roller shaft 62 so as to be engaged with the input gear 67. The developer roller drive gear 69 is incapable of rotating relative to the metal developing roller shaft 62.

The intermediate gear 70 is rotatably supported in front of the input gear 67 on an intermediate gear support shaft 74. The intermediate gear support shaft 74 protrudes laterally from the outer side of one side wall 58. The intermediate gear 70 is a two-stage gear integrally formed of outer teeth 75 that engage with the input gear 67, and inner teeth 76 that engage with the agitator drive gear 71.

The agitator drive gear 71 is disposed diagonally in front of and below the intermediate gear 70 on an axial end of the agitator rotational shaft 35. The agitator drive gear 71 is incapable of rotating relative to the agitator rotational shaft 35. The agitator drive gear 71 is a two-stage gear integrally formed of inner teeth 77 that engage with the inner teeth 76 of the intermediate gear 70, and outer teeth 78 that engage with the detection gear 82.

The detection gear 82 is rotatably supported, at the obliquely lower rear position of the agitator drive gear 71, by a detection gear support shaft 83 which protrudes from the one side wall 58 toward the outside in the widthwise direction thereof. The detection gear 82 is positioned below the gear cover 66 so as to be exposed therefrom. The obliquely upper rear portion of the detection gear 82 confronts the toner detection window 38 formed on the one side wall 58 in the widthwise direction.

The detection gear 82 is formed as a partially untoothed gear integrally including a detection gear main body 84, a toothed portion 85, and an untoothed portion 86.

The detection gear main body 84 has substantially a disk-shape. The detection gear support shaft 83 is inserted into the center of the detection gear main body 84 so as to be rotatable relative to the detection gear main body 84. A cut portion 87 having substantially a fan-like shape as viewed from the side is formed on a part of the detection gear main body 84. The cut portion 87 serves as a transmission portion that can confront the toner detection window 38 with a rotation of the detection gear 82. Further, a display portion 88 is formed on the detection gear main body 84 at the portion on the same trajectory as the cut portion 87 along the circumferential direction of the detection gear main body 84. The display portion 88 can overlap, in the widthwise direction of the developer cartridge 28, with the toner detection window 38 by a rotation of the detection gear 82. The display portion 88 is formed along the circumferential direction of the detection gear main body 84 so as to partially encircle the detection gear support shaft 83. A barcode that indicates identification information relating to the developer cartridge 28 is formed on the display portion 88. The barcode is an optically-readable reflection pattern.

The barcode corresponds to information on the developer cartridge 28 relating to the amount of toner accommodated in the toner-accommodating chamber 34 when the developer cartridge 28 is new. In other words, the barcode corresponds to information on the maximum number of sheets 3 on which images can be formed with the amount of toner accommodated in the toner-accommodating chamber 34 (hereinafter referred to as the maximum number of sheets to be printed).

More specifically, the barcode formed on the detection gear 82 of the developer cartridge 28 as shown in FIG. 2 corresponds to information indicating that the maximum number of sheets to be printed is 6000; whereas the barcode formed on the detection gear 82 of the developer cartridge 28 as shown in FIG. 7 corresponds to information indicating that the maximum number of sheets to be printed is 3000.

The toothed portion 85 is partially formed on the peripheral surface of the detection gear main body 84. That is, the toothed portion 85 is continuously formed from one end portion to the other end portion in the circumferential direction, while the toothed portion 85 is not formed on a part of the peripheral surface of the detection gear main body 84 (i.e., untoothed portion 86). The outer teeth 78 of the agitator drive gear 71 is engaged with the toothed portion 85 to allow the driving force from the motor 59 to be transmitted to the toothed portion 85.

The untoothed portion 86 is a part on the peripheral surface of the detection gear main body 84, other than the part where the toothed portion 85 is formed. More specifically, the untoothed portion 86 is formed along the peripheral surface of the detection gear main body 84 over an angular range of about 45 degrees. The outer teeth 78 of the agitator drive gear 71 does not engage with the untoothed portion 86, so that the transmission of the driving force of the motor 59 is interrupted (discontinued).

In a state where the developer cartridge 28 has been mounted in the main casing 2, the motor 59 is coupled to the coupling receiving part 73 to allow the input gear 67 to be rotated with a drive of the motor 59. The rotation of the input gear 67 in turn rotates the supply roller drive gear 68, developer roller drive gear 69, and intermediate roller 70 which are directly engaged with the input gear 67, and the agitator drive gear 71 and detection gear 82 which are indirectly engaged with the input gear 67 through the intermediate gear 70.

As shown in FIG. 2, the gear cover 66 is attached to the one side wall 58 of the developer cartridge 28 so as to cover the gear mechanism 65. An opening 80 is formed on the rear side of the gear cover 66. The coupling receiving part 73 is exposed through the opening 80.

As shown in FIGS. 8 and 9, the main casing 2 includes an information detecting mechanism 81 which serves as a detecting portion that irradiates the inside of the toner-accommodating chamber 34 with a detection light through the toner detection window 38 of the developer cartridge 28 to optically detect presence or absence of the toner accommodated in the toner-accommodating chamber 34.

The information detecting mechanism 81 includes the light-emitting element 89, a first light-receiving element 90, and the second light-receiving element 91. The light-emitting element 89 is disposed outside the toner detection window 38 formed on the one side wall 58 of the developer cartridge 28 in the widthwise direction so as to confront the toner detection window 38 and emits a detection light toward a detection position which is a portion of the detection gear 82, the portion confronting the toner detection window 38. The first light-receiving element 90 is disposed on the same side as the light-emitting element 89 with respect to the developer cartridge 28 and serves as a first light-receiving portion. The second light-receiving element 91 is disposed on a portion outside the toner detection window 38 formed on the other side wall 58 of the developer cartridge 28 in the widthwise direction so as to confront the toner detection window 38, the portion being opposite to the light-emitting element 89 across the toner-accommodating chamber 34 of the developer cartridge 28 in the widthwise direction. Within the main casing 2, main frames 2C are disposed on both sides in the widthwise direction, across the developer cartridge 28. The light-emitting element 89 and first light-receiving element 90 are attached to one main frame 2C that confronts the gear mechanism 65, and the second light-receiving element 91 is attached to the other main frame 2C.

The cut portion 87 and display portion 88 formed on the detection gear 82 can pass the detection position which is the common point of passage with a rotation of the detection gear 82. Upon rotation of the detection gear 82, while the display portion 88 passes the detection position with a detection light emitted from the light-emitting element 89 toward the detection position, the detection light from the light-emitting element 89 is reflected by the display portion 88 and is received by the first light-receiving element 90 (see FIG. 8). On the other hand, while the cut portion 87 passes the detection position, the detection light from the light-emitting element 89 is transmitted through the cut portion 87 and enters the toner-accommodating chamber 34 through the toner detection window 38 formed on the one side surface 58. In this case, if toner is absent in the toner-accommodating chamber 34, the detection light passes through the toner-accommodating chamber 34 without being blocked by toner. The detection light is then emitted from the toner detection window 38 formed on the other side wall 58 and received by the second light-receiving element 91 (see FIG. 9).

As shown in FIG. 8, a CPU 100 is provided within the main casing 2. The CPU 100 serves as an information determining portion that determines information on the developer cartridge 28 mounted in the main casing 2 based on the detection result of the detection light obtained by the information detecting mechanism 81 and, more specifically, information indicating whether the developer cartridge 28 mounted in the main casing 2 is new, or information which is based on the amount of toner accommodated in the toner-accommodating chamber 34 when the developer cartridge 28 is new. Even more specifically, the CPU 100 serves as a maximum number-of-sheet determining portion that determines the maximum number of sheets to be printed with the developer cartridge 28 and a life determining portion that determines that the developer cartridge 28 reaches an end of life.

The light-emitting element 89, first light-receiving element 90, and second light-receiving element 91 are connected to the CPU 100. A light-receiving signal from the first light-receiving element 90 and second light-receiving element 91 is inputted to the CPU 100.

<Operations for Detecting a New Developer Cartridge>

Next, a method will be described for determining whether the developer cartridge 28 mounted in the main casing 2 is new or old and for determining the maximum number of sheets to be printed with the developer cartridge 28.

In this method, the front cover 2B is first opened, and the process cartridge 17 on which the new developer cartridge 28 is mounted is inserted into the main casing 2 through the access opening 2A. Alternatively, the front cover 2B is opened and the new developer cartridge 28 is inserted through the access opening 2A and mounted on the process cartridge 17 already mounted in the main casing 2.

As shown in FIG. 2, in the case where the developer cartridge 28 is new, a leading (front) end of the display portion 88 in a moving direction is stopped at a position confronting the toner detection window 38. When the developer cartridge 28 is mounted in the main casing 2, a coupling insertion portion (not shown) is inserted into the coupling receiving part 73 of the input gear 67 of the developer cartridge 28 to allow the driving force from the motor 59 provided in the main casing 2 to be transmitted to the coupling insertion portion. This enables the input gear 67, supply roller drive gear 68, developer roller drive gear 69, intermediate gear 70, agitator drive gear 71 and detection gear 82 of the gear mechanism 65 to be driven.

Next, when the developer cartridge 28 is mounted in the main casing 2, the CPU 100 initiates a warm-up operation in which an operation is executed to idly rotate the agitator 36.

In this idle rotation operation, the CPU 100 drives the motor 59 provided in the main casing 2. The driving force of the motor 59 is inputted from the coupling insertion part into the input gear 67 of the developer cartridge 28 via the coupling receiving part 73 and drives the input gear 67 to rotate. At this time, the supply roller drive gear 68 engaged with the input gear 67 is driven to rotate. The rotation of the metal supply roller shaft 60 in turn rotates the supply roller 33. Further, the developer roller drive gear 69 engaged with the input gear 67 is driven to rotate, and the rotation of the metal developing roller shaft 62 in turn rotates the developing roller 31. Further, the intermediate gear 70 engaged with the input gear 67 via the outer teeth 75 is driven to rotate, causing the inner teeth 76 formed integrally with the outer teeth 75 to rotate. When the inner teeth 76 of the intermediate gear 70 rotate, the agitator drive gear 71 engaged with the inner teeth 76 is driven to rotate. The rotation of the agitator rotational shaft 35 rotates the agitator 36, which stirs the toner in the toner-accommodating chamber 34 and generates a flow of toner. When the agitator drive gear 71 is driven to rotate, the detection gear 82 engaged with the outer teeth 78 of the agitator drive gear 71 is driven to rotate.

Figure 3:
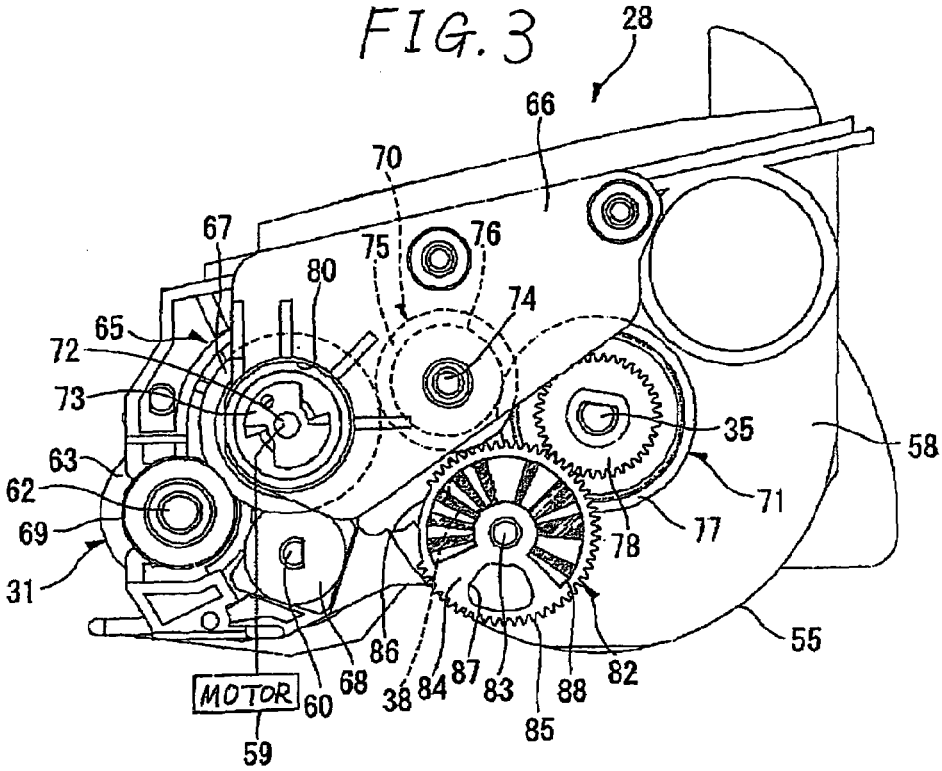
FIG. 3 is a side view of the developer cartridge (maximum number of sheets to be printed is 6000) after the start of the idle rotation operation.
Figure 4:
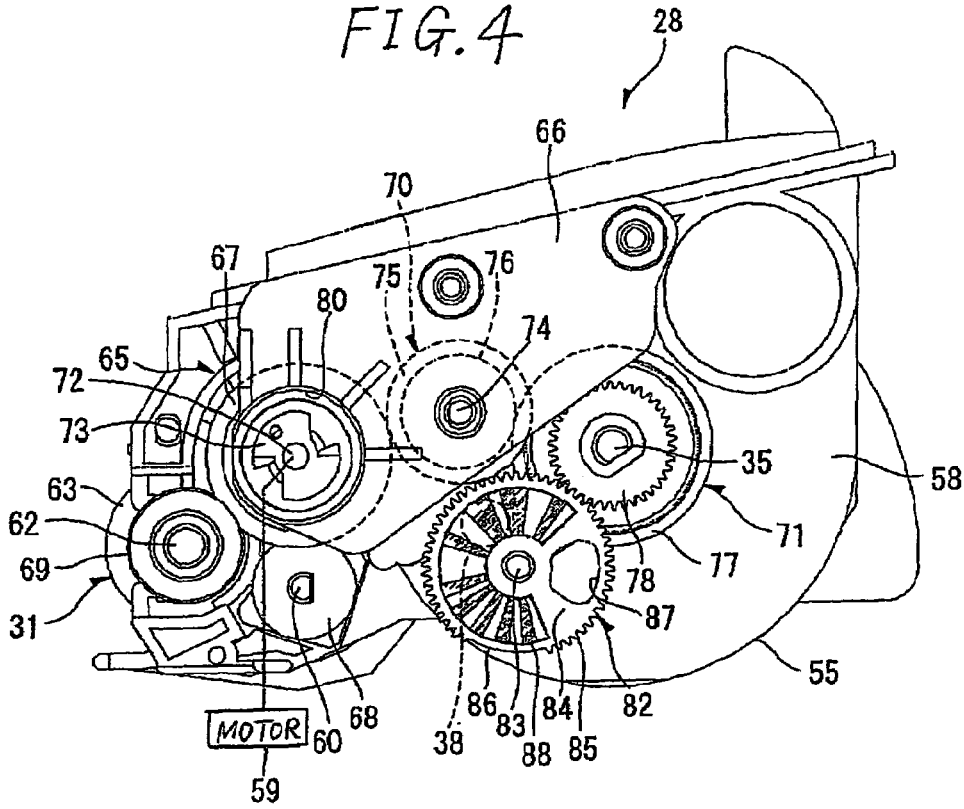
FIG. 4 is a side view of the developer cartridge (maximum number of sheets to be printed is 6000) during the idle rotation operation.
Figure 5:
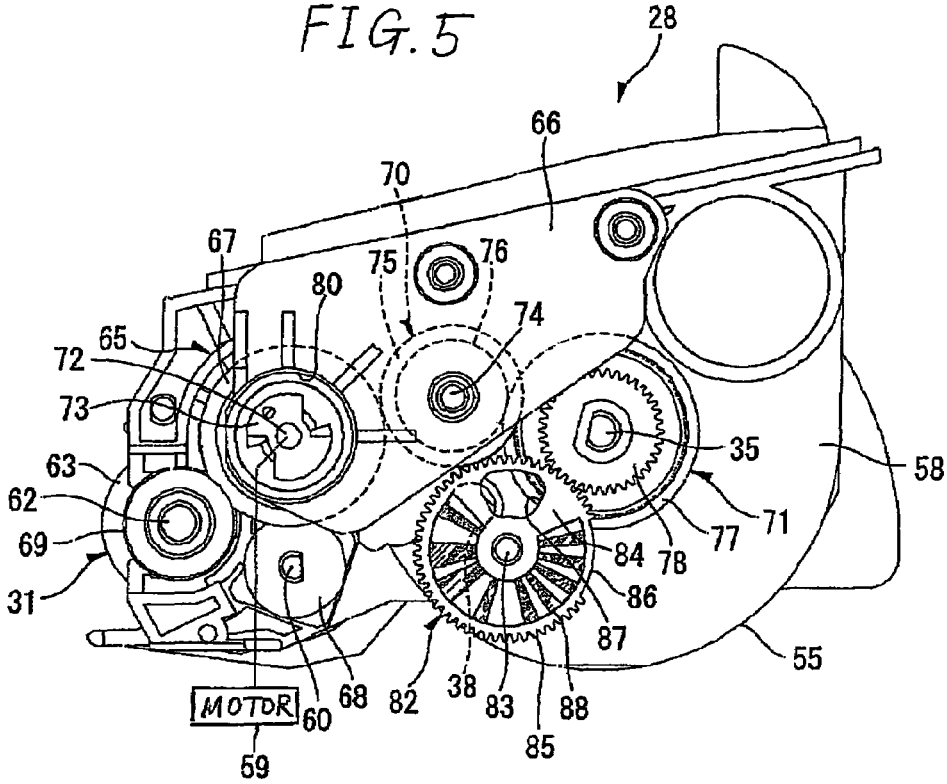
FIG. 5 is a side view of the developer cartridge (maximum number of sheets to be printed is 6000) before the end of the idle rotation operation.

When the detection gear 82 is driven to rotate, the leading (front) end of the display portion 88 which is located at the detection position at the time point when the developer cartridge 28 is mounted in the main casing 2 (see FIG. 2) is moved in the circumferential direction A (counterclockwise direction shown in FIG. 2). The entire display portion 88, that is, from the leading (front) end to trailing (rear) end, then passes through the detection position (first position) as shown in FIGS. 3 through 5. While the display portion 88 passes through the detection position, the detection light from the light-emitting element 89 is reflected with a reflection pattern corresponding to the barcode on the display portion 88, and received, with a light-receiving pattern corresponding to the reflection pattern, by the first light-receiving element 90. The resultant light-receiving signal is then inputted to the CPU 100. Upon receiving the light-receiving signal, the CPU 100 resets the number of printed sheets detected by the paper discharge sensor 64.

Figure 6:
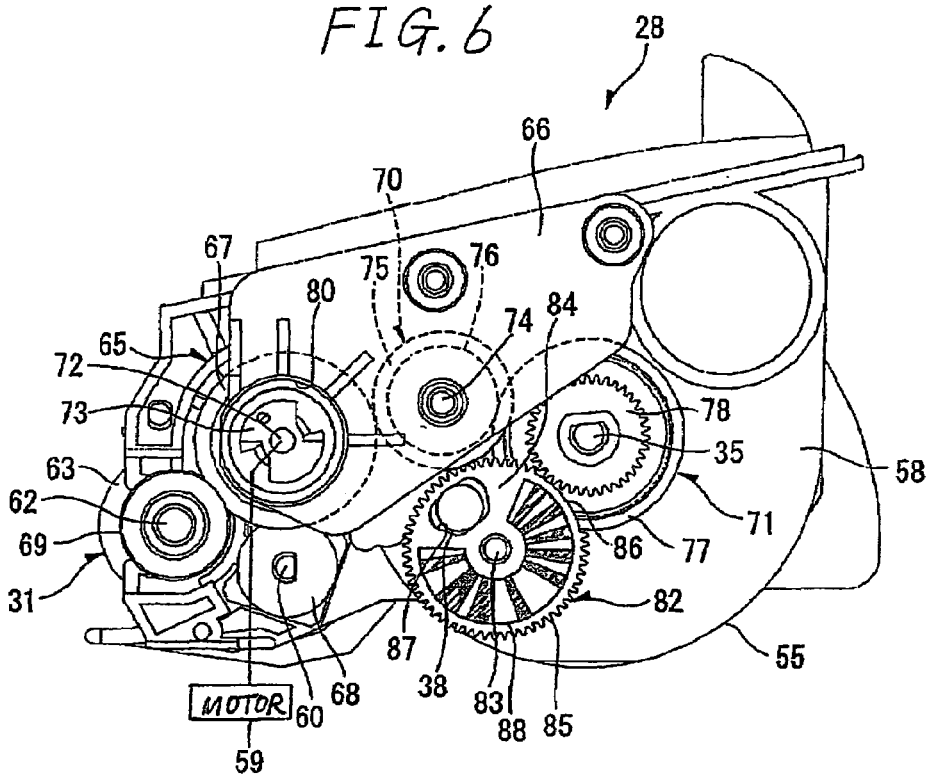
FIG. 6 is a side view of the developer cartridge (maximum number of sheets to be printed is 6000) after the end of the idle rotation operation.

When the detection gear 82 is further driven to rotate, the cut portion 87 reaches the position confronting the toner detection window 38 as shown in FIG. 6, where the rotation of the detection gear 82 is stopped. At this time, the display portion 88 is located at a position (second position) different from the detection position (first position). More specifically, the detection gear 82 is driven to rotate only while the toothed portion 85 thereof is engaged with the outer teeth 78 of the agitator drive gear 71. Accordingly, the detection gear 82 is rotated about the detection gear support shaft 83 in accordance with the toothed portion 85 as shown in FIGS. 2 through 5 and, after that, the agitator drive gear 71 rotates idly relative to the detection gear 82 at the untoothed portion 86 of the detection gear 82 as shown in FIG. 6. As a result, the rotation of the detection gear 82 is stopped. The stop state of the detection gear 82 is maintained by a frictional resistance between the detection gear 82 and the detection gear support shaft 83.

In the above-described idle rotation operation, the CPU 100 determines whether the developer cartridge 28 is new based on the light-receiving signal from the information detecting mechanism 81 and determines the maximum number of sheets to be printed with the developer cartridge 28.

That is, as shown in FIG. 8, when the detection light from the light-emitting element 89 is reflected by the display portion 88 and received by the first light-receiving element 90, the CPU 100 determines that the currently mounted developer cartridge 28 is new.

Further, the CPU 100 determines the maximum number of sheets to be printed with the developer cartridge 28 based on the light-receiving pattern of the detection light which is received by the first light-receiving element 90 in accordance with the reflection pattern corresponding to the barcode on the display portion 88. In the CPU 100, the light-receiving pattern received by the first light-receiving element 90 is associated with information relating to the maximum number of sheets to be printed. More specifically, for example, the light-receiving pattern corresponding to the barcode displayed on the display portion 88 shown in FIGS. 2 through 6 is associated with information indicating that the maximum number of sheets to be printed is 6000, and the light-receiving pattern corresponding to the barcode displayed on the display portion 88 shown in FIG. 7 is associated with information indicating that the maximum number of sheets to be printed is 3000.

Hence, when the developer cartridge 28 is mounted in the main casing 2 in the examples of FIGS. 2 through 6, the CPU 100 determines that the developer cartridge 28 is new and determines that the maximum number of sheets to be printed with the developer cartridge 28 is 6000. The CPU 100 counts the actual number of printed sheets detected by the paper discharge sensor 64 since the developer cartridge 28 was mounted and displays an out-of-toner warning on a control panel or the like (not shown) when the actual number of printed sheets approaches or reaches 6000.

In the example of FIG. 7, when the developer cartridge 28 is mounted, the CPU 100 determines that the developer cartridge 28 is new and that the maximum number of sheets to be printed with the developer cartridge 28 is 3000. The CPU 100 then counts the actual number of printed sheets detected by the paper discharge sensor 64 since the developer cartridge 28 is mounted and displays an out-of-toner warning on the control panel or the like (not shown) when the actual number of printed sheets approaches or reaches 3000.

On the other hand, if a new developer cartridge 28 is once removed from the main casing 2 after the developer cartridge 28 is mounted and is then remounted, a warming-up operation is started to perform the idle rotation operation for rotating the agitator 36. In this case, however, the agitator drive gear 71 rotates idly relative to the detection gear 82 at the untoothed portion 86 of the detection gear 82 to maintain the detection gear 82 in a stop state (stop position) as described above, so that the detection light from the light-emitting element 89 is not reflected by the display portion 88. As a result, the detection light is not received by the first light-receiving element 90. Therefore, the CPU 100 determines that the currently mounted developer cartridge 28 is a used one based on that the first light-receiving element 90 has not received the detection light by the end of the idle rotation operation.

After the idle rotation operation, the agitator drive gear 71 rotates idly relative to the detection gear 82 at the untoothed portion 86 to maintain the detection gear 82 in a stop state to allow the cut portion 87 of the detection gear 82 to confront the toner detection window 38 as shown in FIG. 6. Therefore, the CPU 100 detects the presence or absence of the toner accommodated in the toner-accommodating chamber 34 depending on whether the detection light from the light-emitting element 89 is transmitted through the cut portion 87 and received by the second light-receiving element 91 provided opposite to the light-emitting element 89 across the toner-accommodating chamber 34. That is, if there is a predetermined amount of toner in the toner-accommodating chamber 34, the detection light which travels from the light-emitting element 89, passes through the cut potion 87 and toner detection window 38, and enters the toner-accommodating chamber 34, but is blocked by the toner in the toner-accommodating chamber 34 and is not received by the second light-receiving element 91. The CPU 100 then determines that the toner exists in the toner-accommodating chamber 34 based on that the detection light is not received by the second light-receiving element 91.

On the other hand, when the amount of the toner in the toner-accommodating chamber 34 is less than a predetermined amount, the detection light which travels from the light-emitting element 89, passes through the cut portion 87 and toner detection window 38, and enters the toner-accommodating chamber 34 is not blocked by the toner in the toner-accommodating chamber 34 and is received by the second light-receiving element 91 as shown in FIG. 9. The CPU 100 then determines that there is no toner in the toner-accommodating chamber 34 based on that the detection light is received by the second light-receiving element 91 and displays an out-of-toner warning on the control panel or the like (not shown).

That is, the CPU 100 displays an out-of-toner warning on the control panel or the like (not shown) either when the actual number of printed sheets measured based on the detection result obtained by the paper discharge sensor 64 reaches the maximum number of sheets to be printed determined based on the light-receiving signal input from the first light-receiving element 90, or when the CPU 100 determines that there is no toner in the toner-accommodating chamber 34 based on the light-receiving signal input from the second light-receiving element 91.

<Effects of Function for Detecting New Developer Cartridge>

As described above, according to the laser printer 1 in the above-described aspects, when the developer cartridge 28 is mounted in the main casing 2, the detection gear 82 is driven to rotate by the motor 59 as the idle rotation operation. With the rotation of the detection gear 82, the display portion 88 formed on the detection gear 82 is moved in the circumferential direction A to pass through the detection position. The first light-receiving element 90 of the information detecting mechanism 81 detects identification information relating to the maximum number of sheets to be printed based on a light-receiving pattern corresponding to the barcode displayed on the display portion 88. The CPU 100 then determines the maximum printable number of pages based on the light-receiving signal corresponding to the light-receiving pattern inputted from the first light-receiving element 90.

When the idle rotation operation ends, the cut portion 87 reaches the position confronting the toner detection window 38, where the rotation of the detection gear 82 is stopped. Therefore, the information detecting mechanism 81 detects the light which is emitted from the light-emitting element 89, transmits through the cut portion 87, passes through the toner-accommodating chamber 34, and is received by the second light-receiving element 91. The CPU 100 then detects the presence or absence of the toner in the toner-accommodating chamber 34 based on the detection result obtained by the second light-receiving element 91.

Therefore, the information detecting mechanism 81 can also detect the identification information relating to the maximum number pf sheets to be printed as well as the presence or absence of the toner in the toner-accommodating chamber 34. As a result, information relating to the maximum number of sheets to be printed with the developer cartridge 28 can be determined with a simple structure and at reduced cost.

More specifically, while the display portion 88 of the detection gear 82 passes through the detection position, in the information detecting mechanism 81, the light which is emitted from the light-emitting element 89, reflected by the display portion 88, and received by the first light-receiving element 90 disposed on the same side as the light-emitting element 89 relative to the display portion 88 to allow the identification information relating to the maximum number of sheets to be printed to be optically detected. Further, after the display portion 88 has passed by the detection position, the second light-receiving element 91 of the information detecting mechanism 81 receives the detection light, which has been emitted from the light-emitting element 89 and transmitted through the cut portion 87 at the detection position. The second light-receiving element 91 is disposed opposite to the light-emitting element 89 across the toner-accommodating chamber 34 to optically detect the presence or absence of the toner in the toner-accommodating chamber 34. Therefore, information relating to the maximum number of sheets to be printed with the developer cartridge 28 and presence or absence of the toner can be determined with a simple structure in which one light-emitting element 89 and two light-receiving elements 90 and 91 are simply arranged and at reduced cost.

Further, the display portion 88 on the detection gear 82 displays a barcode corresponding to identification information relating to the maximum number of sheets to be printed in an optically-readable manner by a reflection pattern. The first light-receiving element 90 then receives a light receiving pattern of the detection light in accordance with the reflection pattern. Based on the light receiving pattern, the CPU 100 determines information relating to the maximum number of sheets to be printed with the developer cartridge 28. Therefore, the identification information displayed on the display portion 88 can be reliably detected with a simple structure using the barcode.

The detection gear 82 is a partially untoothed gear including the toothed portion 85 and untoothed portion 86. While the driving force from the motor 59 is transmitted by the toothed potion 85, the detection gear 82 is driven to rotate. On the other hand, while the untoothed portion 86 prevents the driving force from the motor 59 from being transmitted to the detection gear 82, the rotation of the detection gear 82 is stopped. Therefore, the detection gear 82 can be reliably stopped at a predetermined stop position.

When the developer cartridge 28 is mounted in the main casing 2, the driving force from the motor 59 is transmitted to the detection gear 82 through the toothed portion 85 to rotate the detection gear 82. With the rotation of the detection gear 82, the display portion 88 is moved to pass through the detection position to allow the information detecting mechanism 81 to optically detect identification information relating to the maximum number of sheets to be printed which is based on the barcode displayed on the display portion 88. Thereafter, when the untoothed portion 86 prevents the driving force from the motor 59 from being transmitted to the detection gear 82, the detection gear 82 reaches the stop position (stop state) where the cut portion 87 confronts the toner detection window 38, and the detection gear 82 is stopped. The CPU 100 determines whether the developer cartridge 28 is new, by determining whether the first light-receiving element 90 of the information detecting mechanism 81 has detected a light-receiving pattern.

When the detection gear 82 is stopped at the stop position, the detection light which has been emitted from the light-emitting element 89 toward the detection position is transmitted through the cut portion 87 and received by the second light-receiving element 91. Therefore, the presence or absence of the toner in the toner-accommodating chamber 34 can be detected reliably.

The display portion 88 is formed on the detection gear 82 which is formed as a partially untoothed gear. Therefore, identification information relating to the maximum number of sheets to be printed which is based on the barcode displayed on the display portion 88 can be reliably detected by the information detecting mechanism 81.

Since the identification information which is based on the barcode displayed on the display portion 88 is information relating to the maximum number of sheets to be printed with the developer cartridge 28, the CPU 100 can simply and reliably determine the amount of the toner accommodated in the toner-accommodating chamber 34 of the developer cartridge 28. As a result, the life of the developer cartridge 28 can accurately be determined for a plurality of developer cartridges 28 that accommodate different amounts of toner in an unused state, and the used developer cartridge 28 can be replaced with a new one in an appropriate timing.

The CPU 100 determines that the currently mounted developer cartridge 28 reaches the end of life either when the actual number of printed sheets reaches the maximum number of sheets to be printed, or when the CPU 100 determines that there is no toner in the toner-accommodating chamber 34 to display an out-of-toner warning on the control panel (not shown). That is, even when the information detecting mechanism 81 has not yet detected that there is no toner, the CPU 100 determines that the currently mounted developer cartridge 28 reaches the end of life when the actual number of printed sheets reaches the maximum number of sheets to be printed. Therefore, the life of the developer cartridge 28 can be reliably determined even when the toner still exists but has been deteriorated.

While the invention has been described in detail with reference to the above aspects thereof, it would be apparent to those skilled in the art that various changes and modifications may be made therein without departing from the spirit of the invention.

In the aspects described above, the developer cartridge 28 is provided separately from the process frame 51, and the photosensitive drum 27 is provided in the process frame 51. However, the developer cartridge may be formed integrally with the process frame 51.

What is claimed is:

1. An image forming apparatus comprising:

an apparatus main body;

a driving-force generating portion disposed in the apparatus main body and generating a driving force;

a developer cartridge configured to be detachably mounted in the apparatus main body and to accommodate developer, the developer cartridge comprising:

a drive member configured to be driven to move by the driving force when the developer cartridge is mounted in the apparatus main body; and a display portion configured to move together with the drive member, the display portion displaying identification information relating to the developer cartridge in an optically readable manner;

a detecting portion that optically detects the identification information when the display portion is in a first position, and that optically detects presence or absence of the developer in the developer cartridge when the display portion is in a second position different from the first position, the detecting portion comprising:

a light-emitting portion that emits light toward the first position;

a first light-receiving portion that receives the light that is emitted from the light-emitting portion and reflected by the display portion when the display portion is in the first position, and a second light-receiving portion that receives the light that is emitted from the light-emitting portion and that passes through the first position when the display portion is in the second position; and an information determining portion that determines information on the developer cartridge based on the identification information detected by the detecting portion.

2. The image forming apparatus according to claim 1, wherein the developer cartridge comprises a developer accommodating portion that accommodates developer;

wherein the display portion is disposed adjacent to the developer accommodating portion;

wherein the light-emitting portion is disposed in confrontation with the display portion on a side opposite to the developer accommodating portion with respect to the display portion;

wherein the first light-receiving portion is disposed on the same side as the light-emitting portion with respect to the display portion; and wherein the second light-receiving portion is disposed opposite to the light-emitting portion across the display portion and the developer accommodating portion.

3. The image forming apparatus according to claim 1, wherein the display portion displays the identification information in an optically-readable reflection pattern; and wherein the information determining portion determines the information on the developer cartridge based on a pattern of light that is reflected, in accordance with the reflection pattern, by the display portion and received by the first light-receiving portion.

4. The image forming apparatus according to claim 1, wherein the drive member is stopped at a predetermined stop position after the display portion passes through the first position.

5. The image forming apparatus according to claim 4, wherein the drive member is formed with a transmission portion at a position corresponding to the first position in a condition in which the drive member is stopped at the predetermined stop position, the transmission portion being configured to transmit light that is emitted from the light-emitting portion toward the first position and to allow the light to reach the second light-receiving portion.

6. The image forming apparatus according to claim 4, wherein the display portion is in the second position when the drive member is stopped at the predetermined stop position.

7. The image forming apparatus according to claim 4, wherein the drive member comprises a partially untoothed gear including: a toothed portion to which the driving force from the driving-force generating portion is transmitted; and an untoothed portion at which the driving force from the driving-force generating portion is discontinued.

8. The image forming apparatus according to claim 7, wherein the display portion is provided on the partially untoothed gear.

9. The image forming apparatus according to claim 1, wherein the drive member is stopped at a predetermined stop position after the display portion passes through the first position.

10. The image forming apparatus according to claim 1, wherein the information on the developer cartridge includes information relating to an amount of the developer accommodated in the developer cartridge.

11. The image forming apparatus according to claim 10, comprising:

a maximum number-of-sheet determining portion that determines a maximum number of sheets on which images can be formed based on the amount of the developer determined by the information determining portion;

a sheet counting portion that counts a number of printed sheets; and a life determining portion that determines that the developer cartridge reaches an end of life either when the number of printed sheets counted by the sheet counting portion reaches the maximum number of printed sheets determined by the maximum number-of-sheet determining portion or when the detecting portion detects the absence of the developer in the developer cartridge.

12. A developer cartridge configured to be detachably mounted in an apparatus main body of an image forming apparatus and to accommodate developer, the developer cartridge comprising:

a drive member configured to be driven to move by a driving force when the developer cartridge is mounted in the apparatus main body, wherein the drive member comprises a partially untoothed gear including: a toothed portion to which the driving force from a driving-force generating portion is transmitted; and an untoothed portion at which the driving force from the driving-force generating portion is discontinued; and a display portion configured to move together with the drive member, the display portion displaying identification information relating to the developer cartridge in an optically readable manner, wherein the identification information can be optically detected by a detecting portion provided in the apparatus main body when the display portion is in a first position, and the presence or absence of the developer can be optically detected by the detecting portion when the display portion is in a second position different from the first position.

13. The developer cartridge according to claim 12, wherein the drive member is stopped at a predetermined stop position after the display portion passes through the first position.

14. The developer cartridge according to claim 13, wherein the drive member is formed with a transmission portion at a position corresponding to the first position in a condition in which the drive member is stopped at the predetermined stop position, the transmission portion being configured to transmit light.

15. The developer cartridge according to claim 12, wherein the display portion displays the identification information in an optically-readable reflection pattern.

16. The developer cartridge according to claim 12, wherein the display portion is provided on the partially untoothed gear.

17. The developer cartridge according to claim 12, wherein the information on the developer cartridge includes information relating to an amount of the developer accommodated in the developer cartridge.

* * * * *